US005947011A

United States Patent [19]

Xu

[11] Patent Number: 5,947,011

[45] Date of Patent: Sep. 7, 1999

[54] FOOD PLATE WITH THUMB AND BEVERAGE CONTAINER APERTURES FOR GRIPPING AND HOLDING WITH ONE HAND

[76] Inventor: Yuhuan Xu, 908 17th St., Apt. C, Santa Monica, Calif. 90403

[21] Appl. No.: 09/183,921

[22] Filed: Oct. 30, 1998

[51] Int. Cl.[6] ..... A47J 27/00; A47G 19/00; A47G 23/06; B65D 1/36

[52] U.S. Cl. ..... 99/357; 99/484; 206/557; 206/564; 220/23.8; 220/23.83; 220/575

[58] Field of Search ..... 99/340, 357, 484; 206/557, 558, 564, 815, 549, 542; 220/23.8, 23.83, 556, 575, 735, 737; 294/146, 172; D7/555, 553.6, 507, 505, 543, 546, 549, 551.2, 553.1

[56] References Cited

U.S. PATENT DOCUMENTS

| | | | |
|---|---|---|---|
| D. 204,071 | 3/1966 | Earl | D7/553.1 |
| D. 210,614 | 3/1968 | Douglas | D7/551.2 |
| D. 270,324 | 8/1983 | French | D7/505 |
| 2,295,860 | 9/1942 | Oliver | 294/172 |
| 3,106,236 | 10/1963 | Brady | 99/357 |
| 3,209,671 | 10/1965 | Blacker | 99/357 |
| 4,461,396 | 7/1984 | Harper | 220/23.83 |
| 4,744,597 | 5/1988 | Bauman et al. | 294/172 |
| 4,823,958 | 4/1989 | Mahmud | 206/564 X |
| 4,867,331 | 9/1989 | Task | 220/23.8 |
| 4,966,297 | 10/1990 | Doty | 220/23.83 |
| 5,323,910 | 6/1994 | Van De Graaf, Jr. | 206/557 |
| 5,607,077 | 3/1997 | Torrelson | 220/575 |

*Primary Examiner*—Timothy F. Simone
*Attorney, Agent, or Firm*—Kenneth A. Roddy

[57] ABSTRACT

A food plate for containing food and supporting a beverage container wherein the plate and beverage container are held together as a unit by one hand of a person. The food plate has a flat top surface and at least one depression formed therein for containing a food item. A first aperture formed in the plate is sized and shaped to allow passage of a beverage container partially therethrough and engage a mid portion of the beverage container such that the center of gravity of the container is even with or below the top surface of the plate and the lower portion of the container exterior is exposed on the underside of the plate. A second aperture formed in the plate adjacent to the first aperture is sized and shaped to receive the thumb of the person's hand from the underside of the plate. The person's hand is cupped around the exposed lower portion of the beverage container with the fingers gripping the exterior surface of the container, the plate is supported on the top of the cupped hand, and the tip of the thumb is selectively placed against the top surface of the plate or against the upper portion of the beverage container to securely hold the plate and the beverage container together as a single unit. In a preferred embodiment, the beverage container aperture is surrounded by circumferentially spaced tabs extending downwardly from the top surface and biased angularly inward in a radial direction to engage the side wall of the beverage container.

14 Claims, 4 Drawing Sheets

FOOD PLATE WITH THUMB AND BEVERAGE CONTAINER APERTURES FOR GRIPPING AND HOLDING WITH ONE HAND

BACKGROUND OF THE INVENTION

1. Field of the Invention

This invention relates generally to hand-held plates of the type used at parties, picnics and other gatherings, and more particularly to a food plate having a first aperture through which a beverage container partially extends and a second aperture for receiving the thumb of a person holding the plate to facilitate gripping the lower portion of the beverage container and holding the plate and beverage container as a unit.

2. Brief Description of the Prior Art

Hand-held plates of the type used at parties, picnics and other gatherings, which allow the user to hold a plate and carry a beverage container on the plate are known in the art.

Most of these prior art food plates merely support the lower portion of the beverage container on a flat-bottomed surface or inside a shallow depressed compartment. Some prior art plates allow a person to grip the exterior surface of the beverage compartment. However, prior art plates of the type that support the lower portion of the beverage container on a flat-bottomed surface or inside a shallow depressed compartment still allow relative movement between the beverage container and the plate, even if the user is gripping the compartment that holds the beverage container. Thus, the beverage container can tip over, or become accidently dislodged from the plate.

There are several patents which disclose various hand-held plates of the type used at parties, picnics and other gatherings, that allow the user to hold a plate and carry a beverage container on the plate.

Harper, U.S. Pat. No. 4,461,396 discloses a combined plate and glass holder having a flat bottom with a short arcuate wall defining a beverage glass receiving compartment. A thumb receiving aperture is formed between the outer edge of the plate and the beverage container compartment for receiving the thumb of a user's hand. The bottom of the glass is supported on the tip surface of the plate and surrounded by the short arcuate wall. The user's thumb is received in the thumb aperture and pressed against a glass supported in the glass compartment and the underside of the plate is supported on the fingers. Thus, the user can only press against side of the beverage glass with the thumb. Because the beverage container is supported on the top side of the plate, the plate with the beverage container supported thereon would be top heavy. Thus, if the arm of the person holding the plate is bumped or jostled, the beverage container can accidentally tip over or become dislodged from the shallow compartment.

Task, U.S. Pat. No. 4,867,331 discloses a combination plate for food, drink, and utensils that includes a cup-shaped beverage container compartment depending from the underside of the plate which has a bottom surface. The bottom of the beverage container is supported on the bottom surface of the cup-shaped beverage compartment. There is no thumb aperture and the user holds the plate by gripping the outer surface of the cup-shaped beverage compartment with his or her cupped hand. Thus, the user cannot grip or hold the actual beverage container, and if the arm of the person holding the plate is bumped or jostled, the beverage container can accidentally become dislodged from the beverage container compartment.

Doty, U.S. Pat. No. 4,966,297 discloses a food and beverage snack tray having a flat bottom and an inclined peripheral side wall with a short arcuate wall defining a beverage container receiving compartment at one corner. A pair of slots are formed in the side walls adjacent to the corner for receiving the thumb and index finger of a user's hand to grasp a beverage container supported in the beverage container receiving compartment. Because the beverage container is supported on the top side of the plate, the plate with the beverage container supported thereon would be top heavy. Thus, if the arm of the person holding the plate is bumped or jostled, the beverage container can accidentally tip over or become dislodged from the shallow compartment.

Van de Graff, Jr., U.S. Pat. No. 5,323,910 discloses a rectangular party plate having a thumb receiving aperture near one end and a dish-shaped beverage container compartment. The user inserts the thumb through the thumb aperture and supports the plate on the forearm. Van de Graff. Jr., does not teach gripping of the beverage container or the beverage container compartment. Even if the user could grip the beverage container compartment, the bottom of the beverage container is supported on the bottom surface of the dish-shaped beverage compartment, and if the arm of the person holding the plate is bumped or jostled, the beverage container can accidentally tip over or become dislodged from the dish-shaped beverage compartment.

Torkelson, U.S. Pat. No. 5,607,077 discloses a hand-held plate that includes a shallow beverage compartment having a bottom surface with a raised peripheral edge, and a thumb aperture through which the user inserts a thumb for gripping the plate. The bottom of the beverage container is supported on the bottom surface of the shallow beverage compartment. Although the user can grip the plate, there is no way that the user can grip the beverage container. Because the beverage container is supported on the top side of the plate, the plate with the beverage container supported thereon would be top heavy. Thus, if the arm of the person holding the plate is bumped or jostled, the beverage container can accidentally tip over or become dislodged from the shallow compartment.

The present invention is distinguished over the prior art in general, and these patents in particular by a food plate for containing food and supporting a beverage container wherein the plate and beverage container are held together as a unit by one hand of a person. The food plate has a flat top surface and at least one depression formed therein for containing a food item. A first aperture formed in the plate is sized and shaped to allow passage of a beverage container partially therethrough and engage a mid portion of the beverage container such that the center of gravity of the container is even with or below the top surface of the plate and the lower portion of the container exterior is exposed on the underside of the plate. A second aperture formed in the plate adjacent to the first aperture is sized and shaped to receive the thumb of the person's hand from the underside of the plate. The person's hand is cupped around the exposed lower portion of the beverage container with the fingers gripping the exterior surface of the container, the plate is supported on the top of the cupped hand, and the tip of the thumb is selectively placed against the top surface of the plate or against the upper portion of the beverage container to securely hold the plate and the beverage container together as a single unit. In a preferred embodiment, the beverage container aperture is surrounded by circumferentially spaced tabs extending downwardly from the top surface and biased angularly inward in a radial direction to engage the side wall of the beverage container.

SUMMARY OF THE INVENTION

It is therefore an object of the present invention to provide a hand-held plate suitable for use at parties, picnics and other gatherings that allows a plate of food and a beverage container to be held together with one hand.

It is another object of this invention to provide a hand-held food plate that securely holds a beverage container and prevents the container from tipping over and accidently becoming dislodged from the plate.

Another object of this invention is to provide a food plate having a first aperture through which a beverage container partially extends and a second aperture for receiving the thumb of a person holding the plate to facilitate gripping the lower portion of the beverage container and holding the plate and beverage container as a unit with one hand.

Another object of this invention is to provide a food plate having a first aperture through which a beverage container extends and a second aperture for receiving the thumb of a person from the underside of the plate such that person's hand is cupped around the exposed lower portion of the beverage container with the fingers gripping the exterior surface of the container, the plate is supported on the top of the cupped hand, and the tip of the thumb is selectively placed against the top surface of the plate or against the upper portion of the beverage container to securely hold the plate and the beverage container together as a single unit with one hand.

Another object of this invention is to provide a food plate having an aperture sized and shaped to allow passage of a beverage container partially therethrough and engage a mid portion of the beverage container such that the center of gravity of the container is even with or below the top surface of the plate.

A further object of this invention is to provide a food plate having an aperture surrounded by a plurality of depending tabs that receive and frictionally engage the side wall of a beverage container to prevent the container from accidently becoming dislodged from the plate.

A still further object of this invention is to provide a hand-held food plate that securely holds a beverage container which is attractive in appearance and inexpensive to manufacture.

Other objects of the invention will become apparent from time to time throughout the specification and claims as hereinafter related.

The above noted objects and other objects of the invention are accomplished by a food plate for containing food and supporting a beverage container wherein the plate and beverage container are held together as a unit by one hand of a person. The food plate has a flat top surface and at least one depression formed therein for containing a food item. A first aperture formed in the plate is sized and shaped to allow passage of a beverage container partially therethrough and engage a mid portion of the beverage container such that the center of gravity of the container is even with or below the top surface of the plate and the lower portion of the container exterior is exposed on the underside of the plate. A second aperture formed in the plate adjacent to the first aperture is sized and shaped to receive the thumb of the person's hand from the underside of the plate. The person's hand is cupped around the exposed lower portion of the beverage container with the fingers gripping the exterior surface of the container, the plate is supported on the top of the cupped hand, and the tip of the thumb is selectively placed against the top surface of the plate or against the upper portion of the beverage container to securely hold the plate and the beverage container together as a single unit. In a preferred embodiment, the beverage container aperture is surrounded by circumferentially spaced tabs extending downwardly from the top surface and biased angularly inward in a radial direction to engage the side wall of the beverage container.

DESCRIPTION OF THE PREFERRED EMBODIMENT

Figure 1:
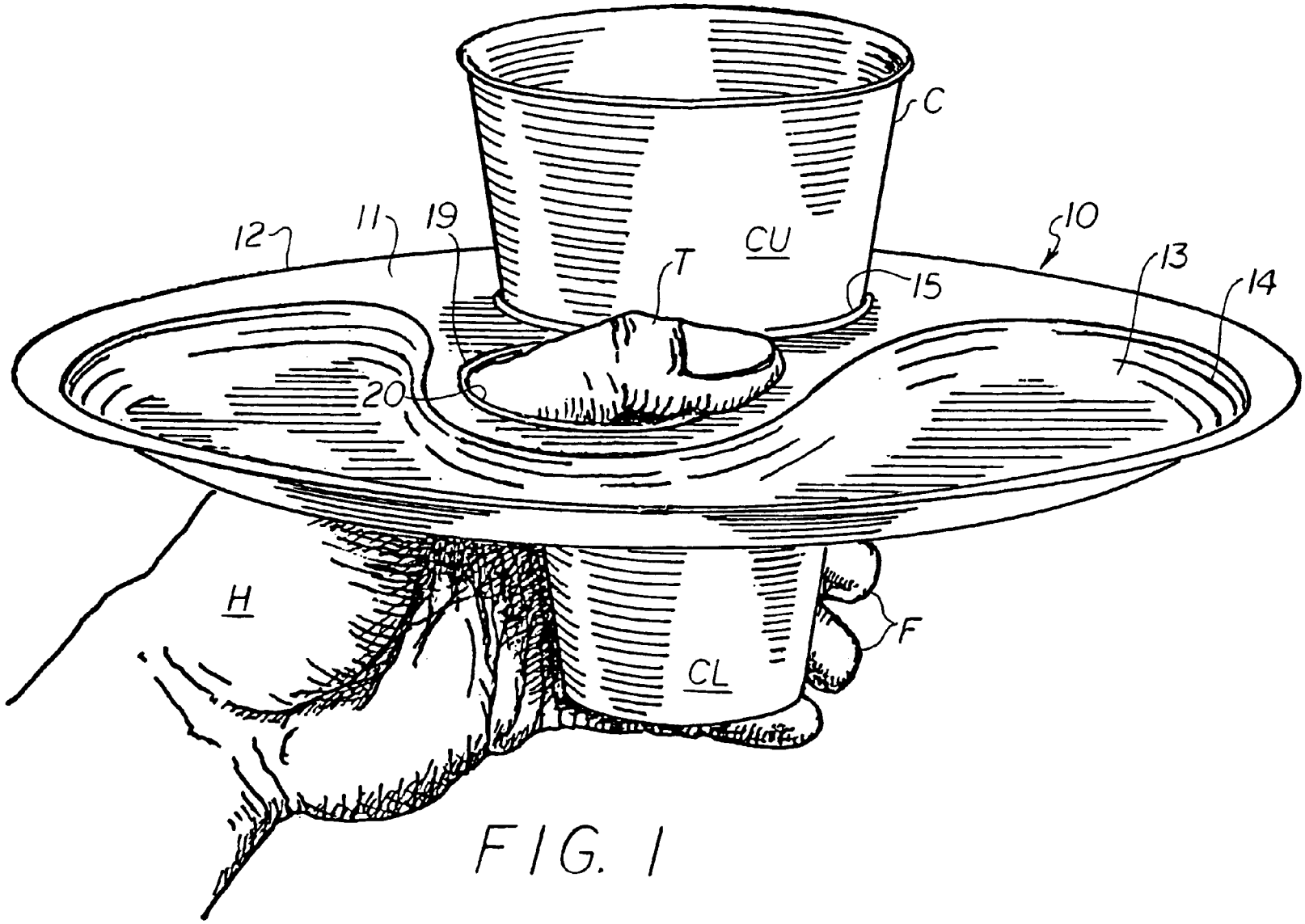
FIG. 1 is a perspective view showing the hand of a person holding a food plate and gripping a beverage container installed partially through the food plate in accordance with the present invention.
Figure 2:
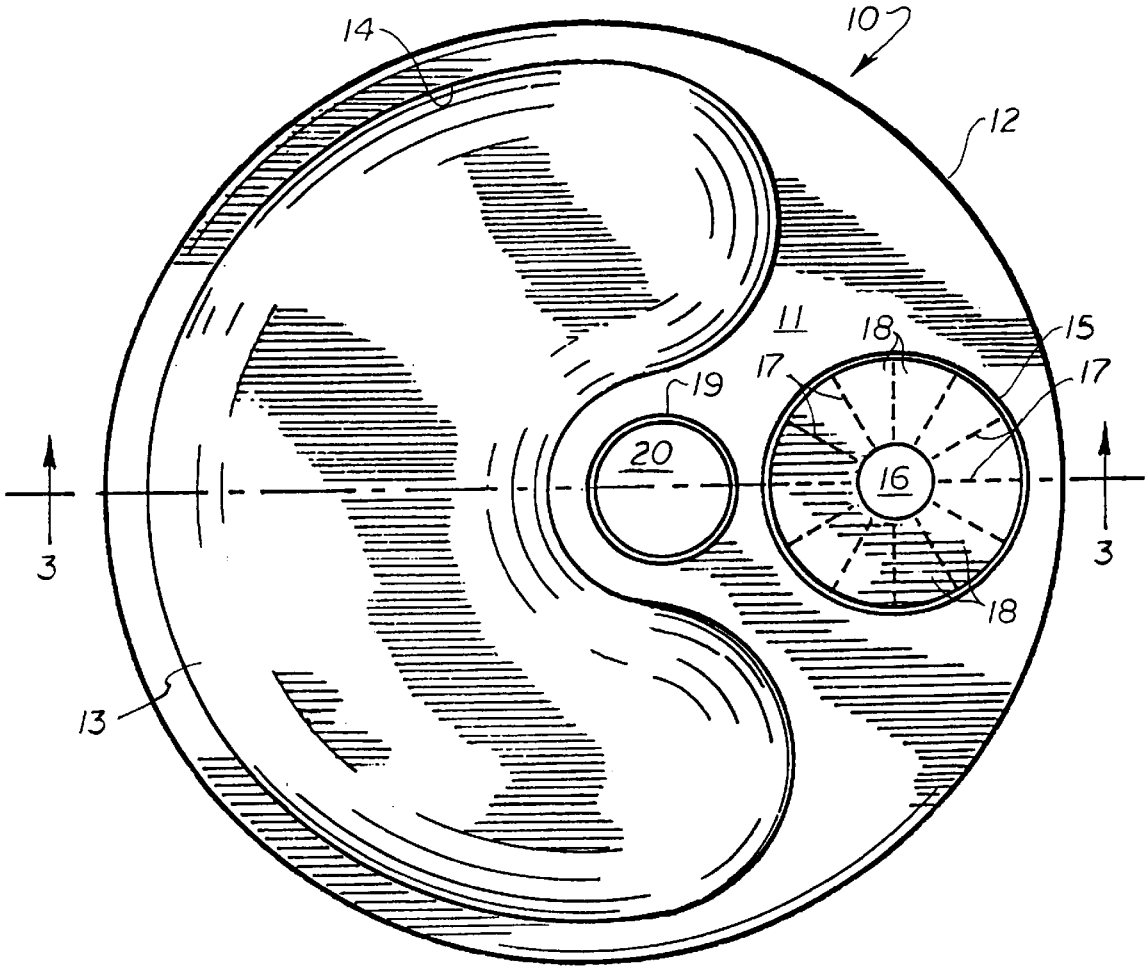
FIG. 2 is a top plan view of the food plate.
Figure 3:
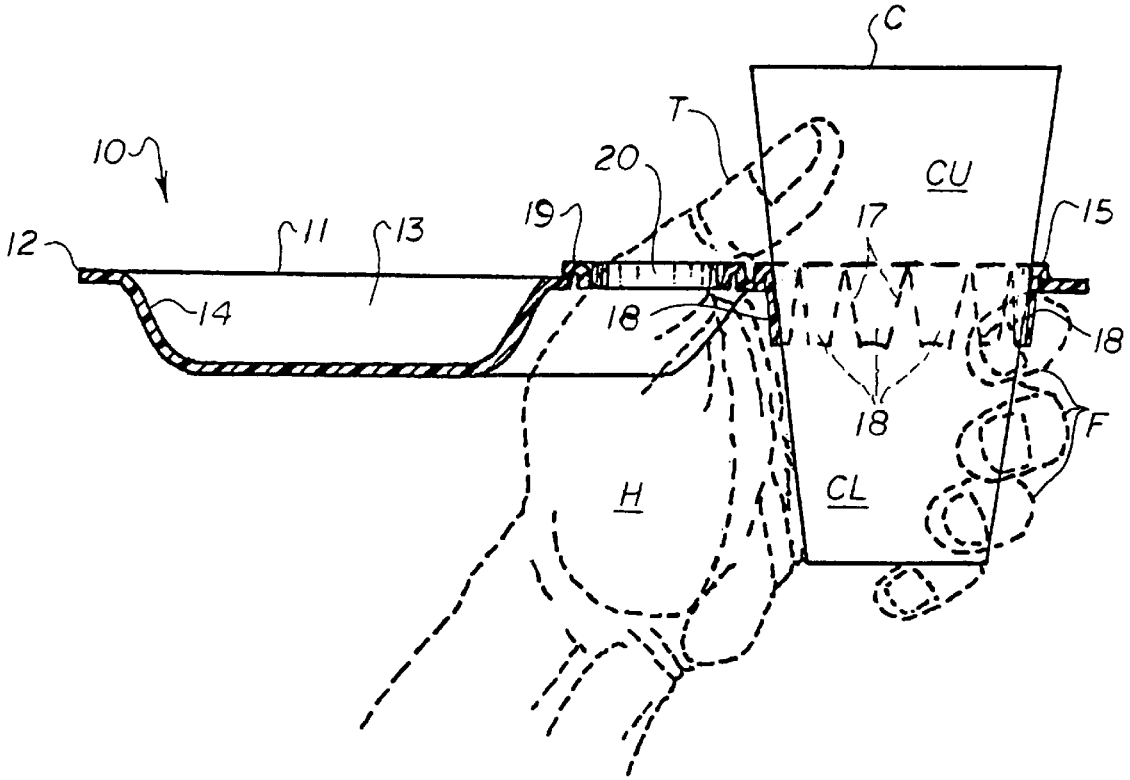
FIG. 3 is a cross section taken along line 3—3 of FIG. 2, showing a beverage container installed in the beverage container aperture engaged by the depending tabs and being gripped by the hand.

Referring to the drawings by numerals of reference, there is shown in FIGS. 1, 2 and 3, a food plate 10 in accordance with the present invention. The food plate 10 is of single piece construction and may be formed of a suitable rigid or semi-rigid material. The plate has a top surface 11 surrounded by a peripheral edge 12 and one or more depressions 13 formed in its surface for containing food. In a preferred embodiment, plate 10 is about 7" to about 11" in diameter and the depressions 13 have a depth of from about ½" to about 1" from the top surface 11 of the plate 10 and have a tapered side wall 14 to facilitate stacking a plurality of the plates. It should be understood that the plate 10 may be provided in other shapes, rather than circular.

Figure 4:
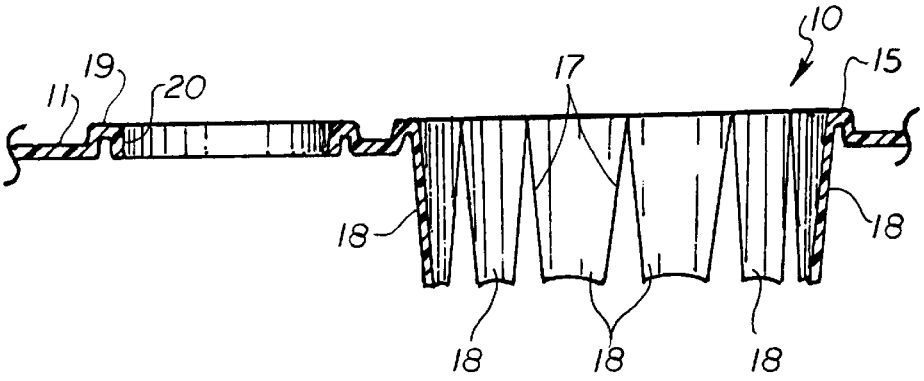
FIG. 4 is an enlarged cross section taken along line 3—3 of FIG. 2, showing the beverage container receiving aperture and thumb receiving aperture surrounded by the raised portions with the container gripping tabs in the depending position.

As best seen in FIGS. 2, 3 and 4, the plate 10 has a first raised circular ring portion 15 near the peripheral edge 12 with a hole 16 at the center and a plurality of serrated lines 17 formed in the plate material extending radially outward from the center hole 16 of the raised ring portion 15. The serrated lines 17 define a plurality of generally pie-shaped tab sections 18 therebetween. As described below, the serrated lines 17 are separated in use to form an aperture for receiving a beverage container C such as a cup or glass. In a preferred embodiment, the raised circular ring portion 15 is from about 2" to about 3" in diameter to accept containers having a capacity of about 8 ounces to about 16 ounces and engage the mid portion of the container such that the center of gravity of the beverage container is even with, or below, the top surface 11 of the plate 10.

A second smaller raised circular ring portion 19 surrounding a central opening 20 is formed a short distance from the first raised circular ring portion 15 for receiving the thumb T of the person holding the plate 10. The thumb T is inserted through the opening 20 from the underside of the plate 10. In a preferred embodiment, the second raised circular ring portion 19 is from about ¾" to about 1" in diameter. Alternatively, the circular ring portion 19 and opening 20 may be generally oval-shaped or teardrop-shaped, rather than circular. The surrounding raised ring 19 strengthens and reinforces the plate material around the opening 17.

As shown in FIGS. 3 and 4, when beverage container C, such as a cup or a glass, is placed into the center of the circular ring portion 15 and pressed downwardly, the downward force is applied to the serrated lines 17, and they separate or break away such that the generally pie-shaped tab sections 18 bend downwardly to form a plurality of downwardly extending and inwardly biased tabs 18 which frictionally engage the exterior side wall of the beverage container C. The surrounding raised ring 15 strengthens and reinforces the plate material around the aperture surrounded by the depending the tabs 18.

When the beverage container C is installed, it extends partially through the plate 10 with the depending tabs 18 gripping its mid portion and is surrounded by the raised ring portion 15 of the plate. A person holding the plate 10 inserts his or her thumb T upwardly through the thumb opening 20 and grips the lower portion CL of the beverage container C with the fingers F of their hand H. The plate 10 is supported on the top of the cupped hand and the tip of the thumb T may be placed against the top surface 11 of the plate 10 (FIG. 1) or against the exterior surface of the upper portion CU of the beverage container C (FIG. 3).

Thus, when the beverage container C is installed partially through the plate 10 and gripped by the hand as described above, the plate and the beverage container are securely held together as a single unit similar to a pistol grip position. The center of gravity of the beverage container C is even with, or below, the top surface 11 of the plate 10 to reduce accidental tipping or spilling and the beverage container is also gripped by the depending tabs 18 to reduce relative movement between the container and plate and prevent accidental dislodgement or removal of the container from the plate.

Figure 5:
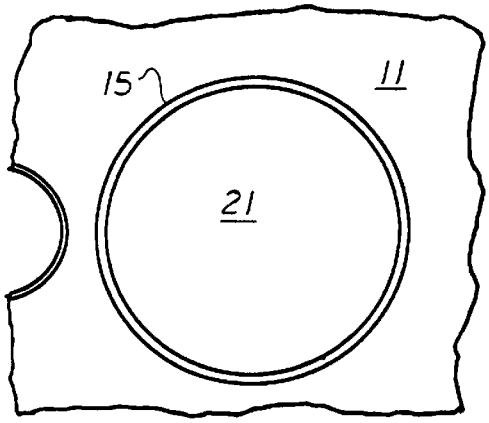
FIG. 5 is a top plan view of an alternate beverage container receiving aperture surrounded by a raised ring.

FIG. 5 shows an alternate beverage container receiving aperture comprising a circular hole 21 surrounded by the raised circular ring 15.

Figure 6:
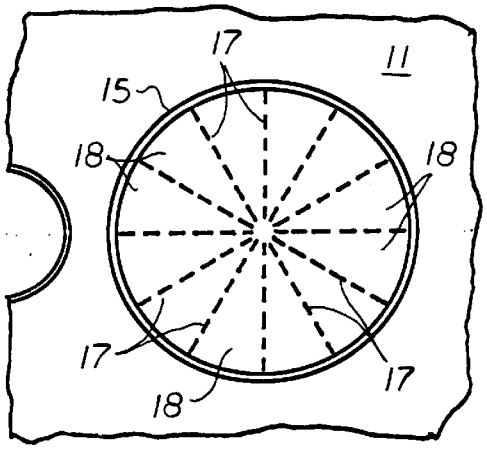
FIG. 6 is a top plan view of an alternate serrated pattern for the beverage container receiving aperture.

FIG. 6 shows an alternate beverage container receiving aperture comprising a plurality of serrated lines 17 that extend inwardly from the surrounding raised circular ring 15 and nearly meet at the center. This pattern forms longer tabs 18 and may be used for engaging smaller beverage containers.

The present invention is a significant improvement over prior art food plates that merely support the beverage container on a flat-bottomed surface or depressed compartment and only allow a person to grip the exterior surface of the beverage compartment, since those types of food plates do not secure the beverage container through the plate and thus allow relative movement between the beverage container and the plate.

While this invention has been described fully and completely with special emphasis upon a preferred embodiment, it should be understood that within the scope of the appended claims the invention may be practiced otherwise than as specifically described herein.

I claim:

1. A food plate for containing food and supporting a beverage container wherein the plate and beverage container are held together as a unit by one hand of a person, comprising:

a food plate having flat upper surface and at least one depression formed therein for containing a food item, and an underside;

a first aperture formed in said plate sized and shaped to allow passage of a beverage container partially therethrough and engage a mid portion of the beverage container whereby a lower portion of the container exterior is exposed on the underside of said plate; and a second aperture formed in said plate adjacent to said first aperture sized and shaped to receive the thumb of the person's hand from the underside of said plate; whereby the person's hand is cupped around the exposed lower portion of said beverage container with the fingers gripping the exterior surface of said container, said plate is supported on the top of the cupped hand, and the tip of the thumb is selectively placed against said top surface of said plate or against the exterior surface of the upper portion of said beverage container to securely hold said plate and said beverage container together as a single unit.

2. The plate according to claim 1, wherein said first aperture and said second aperture are each surrounded by a raised portion of said plate.

3. The plate according to claim 1, wherein said first aperture is sized and shaped to allow passage of said beverage container partially therethrough and engage a mid portion of the beverage container such that the center of gravity of said beverage container is even with or below said top surface of said plate.

4. The plate according to claim 1, wherein said first aperture is surrounded by a plurality of circumferentially spaced tabs extending downwardly from said top surface and biased angularly inward in a radial direction to engage the side wall of said beverage container.

5. The plate according to claim 4, wherein said tabs are formed by plurality of serrated lines formed in said plate top surface defining a plurality of generally tab sections therebetween;

said tab sections being separated and bent downwardly upon receiving a downward force to form said first aperture and form said circumferentially surrounding tabs.

6. The plate according to claim 4, wherein said downwardly extending tabs are of sufficient size and shape to frictionally grip the exterior surface of said beverage container to reduce relative movement between said container and said plate and prevent accidental dislodgement or removal of said container from said plate.

7. The plate according to claim 4, wherein said tabs are formed by plurality of radially extending serrated lines formed in said plate top surface defining a plurality of generally pie-shaped tab sections therebetween;

said pie-shaped tab sections being separated and bent downwardly upon receiving a downward force to form said first aperture and form said circumferentially surrounding tabs.

8. The combination of a food plate for containing food and a beverage container supported partially therein wherein the plate and beverage container are held together as a unit by one hand of a person, the combination comprising:

a food plate having flat upper surface and at least one depression formed therein for containing a food item, and an underside;

a beverage container having a bottom and a tapered side wall for containing a liquid beverage;

a first aperture formed in said plate sized and shaped to allow passage of said beverage container partially therethrough and engage a mid portion of said beverage container whereby a lower portion of said container exterior is exposed on the underside of said plate; and a second aperture formed in said plate adjacent to said first aperture sized and shaped to receive the thumb of the person's hand from the underside of said plate; whereby the person's hand is cupped around the exposed lower portion of said beverage container with the fingers gripping the exterior surface of said container, said plate is supported on the top of the cupped hand, and the tip of the thumb is selectively placed against said top surface of said plate or against the exterior surface of the upper portion of said beverage container to securely hold said plate and said beverage container together as a single unit.

9. The combination according to claim 8, wherein said first aperture and said second aperture are each surrounded by a raised portion of said plate.

10. The combination according to claim 8, wherein said first aperture is sized and shaped to allow passage of said beverage container partially therethrough and engage a mid portion of the beverage container such that the center of gravity of said beverage container is even with or below said top surface of said plate.

11. The combination according to claim 8, wherein said first aperture is surrounded by a plurality of circumferentially spaced tabs extending downwardly from said top surface and biased angularly inward in a radial direction to engage the side wall of said beverage container.

12. The combination according to claim 11, wherein said tabs are formed by plurality of serrated lines formed in said plate top surface defining a plurality of generally tab sections therebetween;

said tab sections being separated and bent downwardly upon receiving a downward force to form said first aperture and form said circumferentially surrounding tabs.

13. The combination according to claim 11, wherein said downwardly extending tabs are of sufficient size and shape to frictionally grip the exterior surface of said beverage container to reduce relative movement between said container and said plate and prevent accidental dislodgement or removal of said container from said plate.

14. The combination according to claim 11, wherein said tabs are formed by plurality of radially extending serrated lines formed in said plate top surface defining a plurality of generally pie-shaped tab sections therebetween;

said pie-shaped tab sections being separated and bent downwardly upon receiving a downward force to form said first aperture and form said circumferentially surrounding tabs.

* * * * *